United States Patent [19]

Hofmann et al.

[11] Patent Number: 4,848,080

[45] Date of Patent: Jul. 18, 1989

[54] CHIPLESSLY FORMED OPEN-END SPINNING ROTOR AND PROCESS FOR PRODUCTION OF SUCH AND OPEN-END SPINNING ROTOR

[75] Inventors: Eberhard Hofmann; Simon Escher, both of Ingolstadt, Fed. Rep. of Germany

[73] Assignee: Schubert & Salzer, Ingolstadt, Fed. Rep. of Germany

[21] Appl. No.: 119,555

[22] Filed: Nov. 12, 1987

Related U.S. Application Data

[60] Division of Ser. No. 65,100, Jun. 19, 1987, Pat. No. 4,777,813, which is a continuation of Ser. No. 829,543, Feb. 11, 1986, abandoned, which is a continuation of Ser. No. 516,132, Jul. 11, 1983, abandoned.

[30] Foreign Application Priority Data

Jul. 22, 1982 [DE] Fed. Rep. of Germany ..... 3227479

[51] Int. Cl.[4] ..... D01H 1/135

[52] U.S. Cl. ..... 57/416; 57/414

[58] Field of Search ..... 57/400, 401, 404, 414, 57/416

[56] References Cited

U.S. PATENT DOCUMENTS

| | | | |
|---|---|---|---|
| 441,368 | 11/1890 | DeLaval | 72/348 |
| 802,082 | 10/1905 | Oldenbusch | 72/83 |
| 1,728,033 | 9/1929 | Blake et al. | 72/85 |
| 3,439,487 | 4/1969 | Landwehrkamp et al. | 57/58.89 |
| 3,481,130 | 12/1969 | Kubovy et al. | 57/416 |
| 3,520,122 | 7/1970 | Shepherd | 57/416 |
| 3,875,731 | 4/1975 | Khemyakov et al. | 57/414 X |
| 3,943,691 | 3/1976 | Mizon et al. | 57/58.89 |
| 4,144,732 | 3/1979 | Franks et al. | 72/84 |
| 4,193,253 | 3/1980 | Herbert et al. | 57/414 |
| 4,216,644 | 8/1980 | Wright et al. | 57/414 |
| 4,319,449 | 3/1982 | Hofmann | 57/58.89 |
| 4,339,911 | 7/1982 | Hofmann | 57/416 |
| 4,385,488 | 3/1983 | Roasch et al. | 57/416 X |
| 4,397,144 | 8/1983 | Raasch et al. | 57/414 |
| 4,502,273 | 3/1985 | Miyamoto et al. | 57/414 |

FOREIGN PATENT DOCUMENTS

| | | | |
|---|---|---|---|
| 2435298 | 5/1980 | France | 72/85 |

OTHER PUBLICATIONS

German Article by Hack, "Auswuchten in der Serienfertigung", 1959.

*Primary Examiner*—Donald Watkins
*Attorney, Agent, or Firm*—Dority & Manning

[57] ABSTRACT

The chiplessly formed open end spinning rotor (1) has, in the region of its collecting groove (11), a surface which has not been contacted by shaping tools. To produce it, a pot (3) is first made by stretching and stamping of flat material. This is then secured in its radial position independently of shaping tools. The peripheral wall of the pot (3), in the region between the later collecting groove (11) and the open edge of the pot (3), is upset inward by any optional kind of plastic deformation and the region later to be the collecting groove (11) by unsupported plastic deformation ["against air"].

15 Claims, 3 Drawing Sheets

Figure 1:
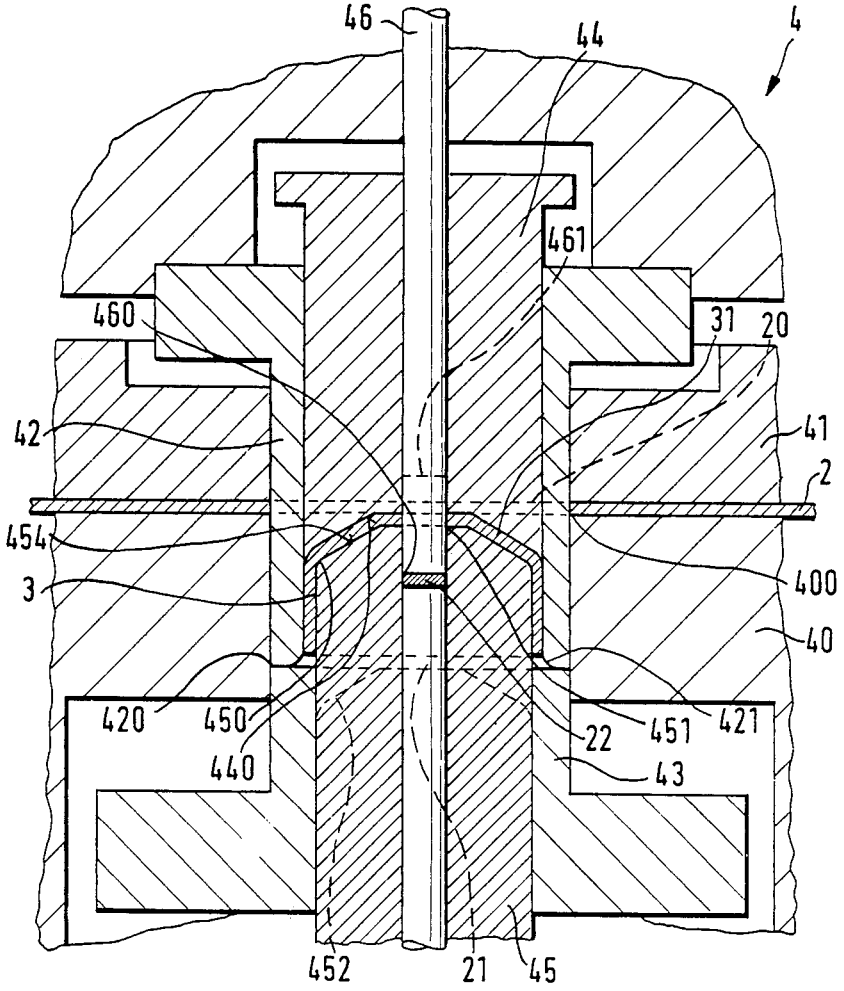

CHIPLESSLY FORMED OPEN-END SPINNING ROTOR AND PROCESS FOR PRODUCTION OF SUCH AND OPEN-END SPINNING ROTOR

This is a division of application Ser. No. 07/065,100 filed June 19, 1987, now U.S. Pat. No. 4,777,813, which is a continuation of application Ser. No. 829,543, filed Feb. 11, 1986, now abandoned, which is a continuation of application Ser. No. 516,132 filed July 11, 1983, now abandoned.

The present invention relates to a chiplessly formed open-end spinning rotor with a collecting groove, and also a process for production of such an open-end spinning rotor.

Up to now, spinning rotors have either been turned from solid or have been produced as castings which were brought to their final form by a chip-forming mode of processing. Such a mode of production is very costly, and on account of this a long service life was sought by tempering and plating the surfaces coming into contact with the fibers. It is however extremely difficult to reach into the collecting groove, so that hardening, and subsequent polishing and plating, of this collecting groove can only be carried out with difficulty.

To eliminate these difficulties it is also already known to produce open-end spinning rotors by chipless forming (DE-OS No. 2,504,401 corresponding to U.S. Pat. No. 3,943,691), the starting material being a metal sheet which is first brought into the shape of a pot by stamping out and deep-drawing. The pot is then upset by means of complementarily-shaped shaping or pressure rollers and pressed into the final rotor form. Here the pressure rollers extend over the whole inner or outer length of the open-end spinning rotor. It has been found that no spinning rotors which are usable for spinning can be produced in this manner, and also that the shaping tool for the collecting groove has only a short service life.

The object of the invention is therefore to produce a chiplessly formed spinning rotor which is usable for open-end spinning, and also a process for production of such an open-end spinning rotor.

A further object is to provide an advantageous process for balancing such thin-walled spinning rotors.

According to the invention, this problem is solved by the spinning rotor having a surface which is untouched by shaping tools in the region of the collecting groove. In this manner very narrow shapes of collecting groove can also be formed which could not be formed at all by means of the usual shaping tools. Moreover, a collecting groove surface which is unchanged during the further processing possesses good properties as regards the yarn produced. Processing striations which act deleteriously on the yarn are effectively prevented in the region of the collecting groove.

By means of a corresponding intensity of plastic deformation, the spinning rotor can receive a wall thickness in the region of its collecting groove which is greater than the wall thickness of the slip wall which adjoins this region. A high bursting speed of rotation is hereby achieved, so that the spinning rotor is suitable for high rotational speeds.

By corresponding selection of the shape of the shaping tools, a collecting groove is folded in such a manner that it has an increasingly widening cross section from the bottom of the collecting groove towards the middle of the rotor, such that tangents to the bounding walls of the collecting groove include between them a constantly increasing angle with increasing distance from the bottom of the collecting groove. Good compression of the fibers in the collecting groove is effected by the narrow cross section in the region of the bottom of the collecting groove. The constantly increasing cross section width thus leads to a low-friction yarn takeoff and facilitates the propagation of twist from the yarn takeoff tube as far as the collecting groove, i.e., as far as the fiber ring located therein.

In order to give greater strength to the open edge, which is susceptible to deformation at high rotational speeds during the processing of certain starting materials, it can be provided that the edge receives a reinforcement, which is preferably constructed as a beading at the external periphery of the open edge of the spinning rotor. Such a beading is also of advantage in open-end spinning rotors which are chiplessly formed according to a known process.

For the production of such a chiplessly formed open-end spinning rotor, according to the invention the pot prefabricated by stretching is secured in its radial position for the second plastic deformation independently of shaping tools, whereupon the peripheral wall of the pot in the region between the later collecting groove and the open edge of the pot is upset inward by an optional kind of plastic deformation, and the region later to be the collecting groove is upset inward by unsupported plastic deformation. By securing the pot independently of the shaping tools, satisfactory shaping of the collecting groove is achieved without the shaping tools coming into contact with the material in the region later to be the collecting groove. By this means not only is a collecting groove produced, but also the material is in addition compressed in this region, so that the material here has a higher strength and wear resistance than the starting material. No deleterious striations arise in the region of the collecting groove during the second plastic deformation which causes upsetting. Since the region of the collecting groove is not mechanically contacted during the whole production process after the production of the pot by stretching, extremely narrow collecting groove shapes can also be produced, which were not hiterto possible because of the necessary smallest dimensions of shaping tools. The spinning rotors can thus be better suited than hitherto to the spinning requirements at any given time. This results also in a smaller number of yarn breaks and in an improvement in spinning results with respect to ease of piecing up and yarn values. The surface of the collecting groove or of the whole internal space of the spinning rotor can be made more wear resistant or adapted to the material to be spun by a plating. However, good spinning results are also obtained with an unchanged surface structure of the collecting groove, which is not plated and, because of the production process according to the invention, also has no kind of processing traces such as pressure striations. From this there results a good self-cleaning effect, so that the susceptibility to failure of the open-end spinning rotor according to the invention is smaller than that of other chiplessly prepared spinning rotors.

Because of the good spinning results which are obtained by means of the surface formed in the second plastic deformation of the pot into the shape of the final open-end spinning rotor and contacted by no shaping tools, advantageously both the collecting groove and also the slip wall of the spinning rotor are formed by unsupported plastic deformation.

As processes for plastic deformation for unsupported upsetting, mould-pressing and roller pressing have been found to be particularly advantageous, so that according to a further feature of the invention the slip wall of the open-end spinning rotor is formed by multi-stage mould-pressing of the pot or by roller pressing by means of shaping rollers. However, according to the material other processes, e.g., drawing processes, can also be found to be advantageous.

Preferably, during pressing by the shaping rollers, the pressure acting radially inward is always exerted only on a limited region of the pot, which is axially displaced during pressing. By this displacement of the pressure, the material in the region of the end of the stroke is pushed together. From this there results a particularly good folding and material compression in the region of the collecting groove, with a correspondingly great wear resistance.

According to the desired folding and/or material compression in the region of the collecting groove, the pressure displacement can be carried out in various ways, for example, by the pressure displacement taking place in a pendular manner. Preferably—in the effort particularly to compress the material in the region of the collecting groove—it is however envisaged according to the invention that the pressure displacement takes place in one or more waves, always from the open edge of the pot in the direction of the collecting groove.

Open-end spinning rotors can be produced from various materials, e.g., from metal sheets of aluminum, steel, spring steel, stainless steel, or nonferrous metal, but also from a plastics plate. These different materials are processed and worked more or less easily and hence also require different handling. Thus it is known, for example, that for plastic deformation of a plastics sheet, heat must be supplied. In order also to make possible a matching to the respective material used in the case of cold-deformable materials (e.g., metal sheets) also, it is envisaged in an appropriate embodiment of the process according to the invention that the number of pressure displacements and/or the pressure hereby exerted is varied to suit the material selected for the open-end spinning rotor.

In roller pressing, there also takes place an extension of the pot and a deformation of its open edge. Advantageously, therefore, according to a further feature of the invention, the spinning rotor can be brought to the desired length dimension after upsetting by cutting off the excess material at the open end.

Securing of the pot during an upsetting plastic deformation can be effected by means of a stationary support and a counter-support connected to the pressing rollers in the region outside the collecting groove; this securement can be carried out by means of rotating or stationary elements. However, it is appropriate for the pot to be secured during the plastic deformation by clamping. For this it is particularly advantageous if the semi-finished spinning rotor has a hole in its floor, so that fastening it to a shaft mounting bolt, base body, etc. is considerably simplified. This hole is advantageously stamped out of the bottom during the formation of the pot. Since all the working steps, both for the plastic deformation and for the stamping of the hole, are carried out in a single working stroke, it is insured in a simple manner that the stamping and the plastic deformation take place concentrically of each other. Thus the otherwise usual multiple clamping and centering processes drop out and much time is saved. The pot with a central hole in the bottom, thus produced, is now fastened to the stationary support by means of a holding device which extends through this hole in the pot bottom; this can be done by the simplest of means. The device carrying the shaping tool can be considerably simplified in this manner.

Since any unbalance of the spinning rotor acts disadvantageously on its drive and on its life, balancing of the spinning rotor is unavoidable. In the state of the art, this takes place by grinding off the spinning rotor at its outer periphery. The relatively thin wall of a chiplessly shaped open-end spinning rotor is however hereby weakened; this is to be avoided on account of strength, particularly as regards the high rotor rpms which are usual today. Therefore according to the invention a smaller hole is stamped out of the bottom of the pot for clamping during the pressing process than will later be required for fastening the finished spinning rotor on its mounting (e.g., rotor shaft), and after it is shaped the spinning rotor is balanced by displacement of its axis of rotation into the axis of inertia, the stamped hole, at first too small, being enlarged to the desired diameter. This balancing procedure can be used for any kind of spinning rotor which is produced by plastic deformation.

Because of the good spinning results obtained with a surface which is unchanged with respect to the starting material, this surface should remain substantially unchanged during the whole production process of the open-end spinning rotor, at least in its collecting groove. It is therefore provided according to the invention, in the case in which the spinning rotor is to be protected against wear by plating, or this is to provide better spinning results, that the starting material is already plated and the pot is only then formed from the plated surface material. In this manner the surface structure of the plated starting material again remains substantially uncontacted during the production process in the region of the collecting groove, so that here too good spinning properties are obtained. This process is also advantageous with other open-end spinning rotors produced by plastic deformation.

The high roational speeds of the rotor which are usual today can, in some circumstances and with various materials, cause a deformation of the spinning rotor. To counteract it, it can be provided in a further embodiment of the invention that the open edge of the spinning rotor is reinforced. This can take place in a simple manner by reinforcing this outer edge by beading outward, possibly subsequent to cutting off of the excess open rotor edge. This reinforcement increases the bursting rpm of the spinning rotor, so that the rotor is suitable for higher rpm's. Reinforcement of the open rotor edge is also advantageous for other open end spinning rotors which are chiplessly formed by plastic deformation.

Chiplessly formed spinning rotors are extraordinarily economical to produce and are therefore usually made as so-called disposable parts. Nevertheless it can be advantageous when chiplessly formed spinning rotors also have a greater stability and are kept for a long time uniformly at a given state as far as concerns their behavior towards fibers. Instead of the plating of the starting material—or in additional to this measure—at least the internal surfaces of the finished, shaped spinning rotor are given, with advantage, a heat and/or chemical treatment. By means of such a treatment, the grain structure of the material is indeed altered—the hardness being increased and stresses in the material reduced—without, however, the surface properties of the spinning rotor being substantially altered. Thus the good spinning results remain unimpaired. Preferably, after such a treatment, or by this treatment, the final shaped spinning rotor is chemically and/or electrochemically deburred and polished.

The process according to the invention makes possible the chipless production of open-end spinning rotors which on the one hand have a low weight and on the other hand, however, are resistant to wear and make possible high rotational speeds, and which in addition give good yarn values. These open-end spinning rotors can be produced both as disposable parts with a high wear resistance, achieved solely by the plastic deformation, and also as parts with an even greater wear resistance due to a final heat—and/or chemical treatment.

Figure 2:
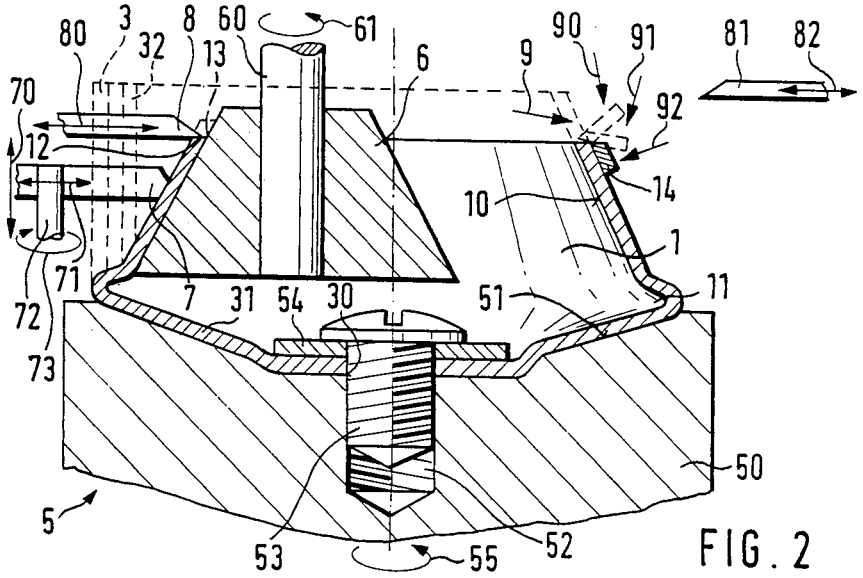
Figure 3:
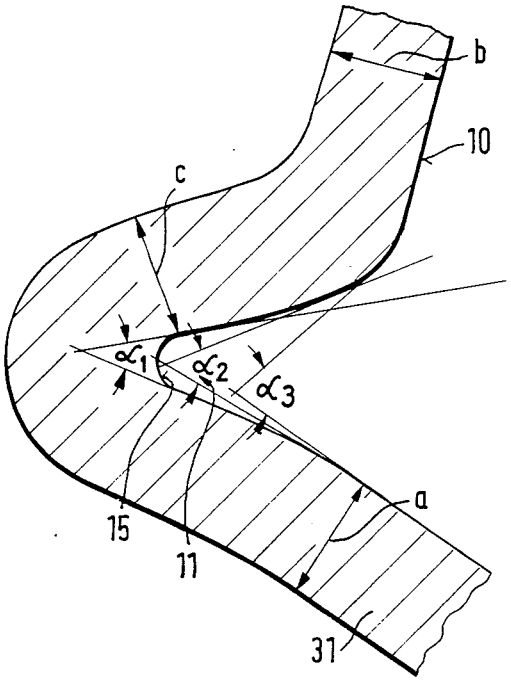
Figure 4:
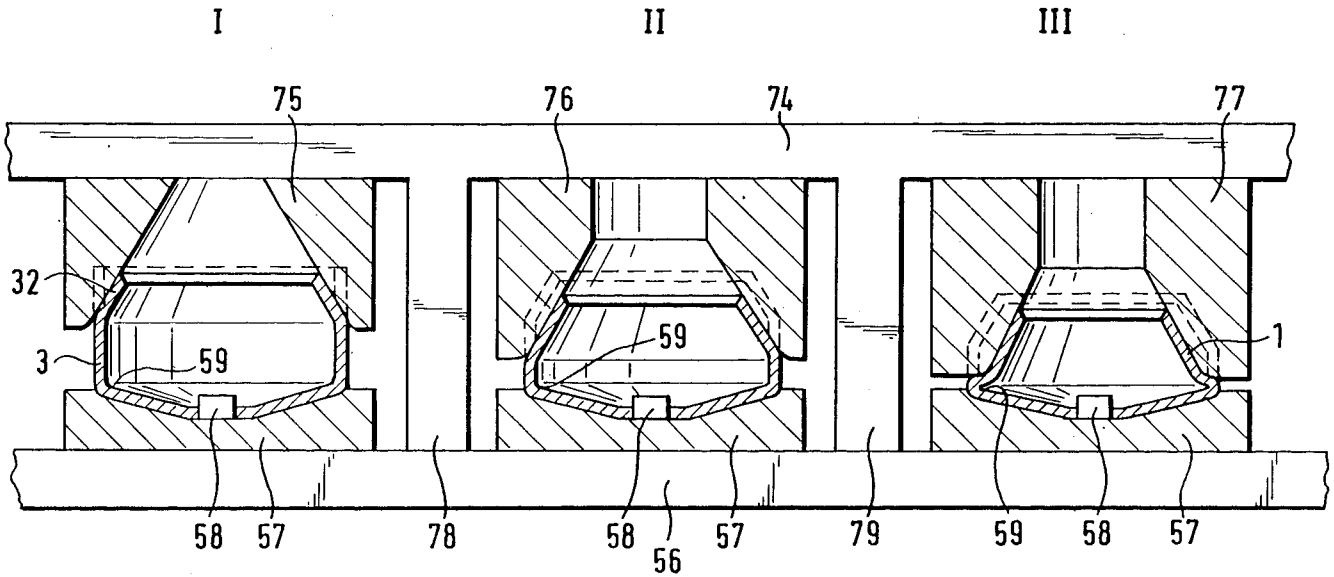

The invention is described in more detail below with reference to drawings. In these are shown:

FIG. 1 in section, the chipless forming of the pot, from which the open-end spinning rotor according to the invention will be produced by roll-pressing;

FIG. 2 an open-end spinning rotor, in section, during the roll pressing process according to the invention; left: spinning rotor with a usual open edge; right: the spinning rotor with an edge reinforced by beading;

FIG. 3 the region of a collecting groove, constructed according to the invention, in cross section; and FIG. 4 an open-end spinning rotor, in section, during the forming/pressing process according to the invention.

The production of the open-end spinning rotor 1 with a slip wall 10 and also a collecting groove 11, which is shown in FIG. 2 in two different examples of embodiments, is explained below with reference to FIGS. 1 and 2.

There is used for the starting material for the production of the open-end spinning rotor 1 a flat material of metal or plastics which has a sufficiently high bursting rpm, in order to withstand a possible deformation at the high rotor speeds usual today. In addition to this, the material must have good spinning properties. As is known from DE-PS No. 1,560,307, corresponding to U.S. Pat. No. 3,439,487 various factors play a part here, for example, good slip properties with respect to fibers, etc. Metal sheets have been found suitable, for example, made of aluminum, steel, spring steel, stainless steel, or non-ferrous metals, but other metals also can of course have the desired properties as regards centrifugal forces and the fibers. However, plastics can also be made use of as starting materials when these have the properties mentioned above and are suitable for chipless shaping. Thus polystyrenes (PS plastics), acrylonitrile-butadiene-styrenes (ABS plastics), and cellulose acetates (CAB plastics) are pertinent. These plastics, with simultaneous action of heat, can certainly be plastically shaped.

For the sake of simplicity, the production of a chiplessly shaped open-end spinning rotor 1 from cold-rolled fine steel sheet 2 will be described as an example (FIG. 1). To produce the pot 3, a cut-draw-cut tool 4 is provided, in which the sheet 2 is inserted. The cut-draw-cut tool 4, known per se, has as essential tool parts a cutter plate 40 on which the sheet 2 to be cut is laid. The cutter plate 40 has a cylindrical recess to receive the cutting stamp 42. Above the cutter plate 40 the tool 4 has a stripper 41 in which the cutting stamp 42 is guided and which likewise fulfills the function of a drawing ring. The cutting stamp 42 is formed in its working region in the shape of a hollow cylinder which has on its outer periphery a sharp annular parting edge 420 which cooperates with a likewise annular sharp parting edge 400 of the cutter plate 40; the parting edge 400 delimits the aperture to receive the cutting stamp 42. In the same recess of the cutter plate 40, into which the cutting stamp 42 can enter, there is furthermore arranged a hold-down 43, which limits the stroke path of the cutting stamp 42. The hold-down 43 is constructed, as is the cutting stamp 42, in the form of a hollow cylinder, but for reasons which will be explained later its internal diameter is smaller than that of the cutting stamp 42.

In the hollow cylindrical-shaped part of the cutting stamp 42 there is mounted an ejector 44 against which can be moved a drawing die 45 located in the hollow cylindrical-shaped part of the hold-down 43. Both the peripheral edge 421, facing the drawing die, of the cutting stamp 42, and also the peripheral edge 450, facing the cutting stamp 42, of the drawing die 45 are also of rounded form.

The mutually facing surfaces 440 and 454 of the ejector 44 or the drawing die 45 have a shape which corresponds to the shape of the spinning rotor 1 to be produced.

The drawing die 45, as the cutting stamp 42, hold-down device 43 and the ejector 44, is constructed as a hollow cylinder, and possesses at its internal periphery, at the end facing the ejector 44, a sharp parting edge 451. In the ejector 44, the internal diameter of which is exactly as large as that of the drawing die 45, a perforating die 46 is guided; it is of massive construction and has a parting edge 460 cooperating with the parting edge 451.

In the description given above of the construction of the cut-draw-cut tool 4, mention of drive devices and the like has been omitted, in order to show the essentials clearly and distinctly. Below, only the production of the pot 3 by means of the tool 4, described as regards construction above, is described:

After the metal sheet 2 has been laid into the tool 4 (position 20), the cutting stamp 42 is lowered and, by cooperation of the two circular cutting edges 400 and 420, a sheet metal disc 21 is stamped out of the metal sheet 2, which is then caught by the hold-down 43. The drawing die, which at first is in its position 452, is now pushed upwards, the sheet metal disc 21 being pressed into the shape of a pot 3. This is made possible in the usual manner, in that the external diameter of the drawing die 45 is somewhat smaller than the internal diameter of the cutting stamp 42, whereby the space needed to receive the pot 3 is created. The round peripheral edges 450 and 521 make possible a slipping of the material out of the flat position which the sheet metal disk 21 will have first assumed. During the deep drawing process by the drawing die 45, the pot 3 reaches the hole stamp 46, which is arranged to be stationary and which has previously been brought from its inoperative position 461 into its working position (shown by full lines). The hole stamp 46 now stamps a sheet metal disk 22 from the bottom 31 of the pot 3; the sharp parting edge 460 of the hole stamp cooperates with the sharp parting edge 451 of the drawing die 45. The semi-finished or finished pot 3 is then fed by the ejector 44 and the drawing die 345 to the hole stamp 46 in an exactly centered position and held during the plastic deformation to stamp out the sheet metal disk 22, so that the hole 30 is exactly central of the pot 3. The stamped-out sheet metal disk 22 now falls through the bore 453 of the drawing die 45 and downward, whence it can later be carried away.

The cutter plate 40 and the stripper 41 are now separated from each other. The ejector 44 throws the pot 3 out of the cutting die, so that this can be removed from the tool 4. The excess open edge of the pot 3 resulting from the plastic deformation of the flat material (e.g., sheet metal 2) can if necessary be cut off, in connection with this process step after completion of deformation, to the desired axial length.

The metal sheet 2 is then pushed into the required new position for the formation of a new pot 3.

According to the material and size or shape of the desired spinning rotor 1, another drawing apparatus or even extruder can be used for the plastic deformation of the flat material which effects stretching of the material.

It is not absolutely necessary for the pot 3 to be made of flat material. According to the material, it is also possible to produce the pot by a cold flow or hot pressing process.

The pot is then, after the plastic deformation which causes a stretching of the material, further processed in a roll press apparatus 5. This roll press apparatus 5 has a support 50, which has a receiver part 51 matching the shape of the bottom 31 of the pot 3. In the middle of the receiver part 51 is a threaded bore 52, provided for a screw 53 which—when it is introduced through the hole 30 resulting from stamping the sheet metal disk 22 out of the bottom of the pot—together with a washer 54 clamps the pot 3 on the support 50 and hence fixes it axially (and also radially).

The roll press apparatus 5 further possesses cooperating shaping rollers in the form of a pressure roller 7 and a shaping chuck 6.

The pressing or shaping chuck 6 has substantially a frustronconical shape, the inclination of which corresponds to the required inclination of the slip wall 10 of the finished spinning rotor 1. The shaping chuck 6 is thus dimensioned or is arranged in the pot 3 during the roll press step such that it can never come into contact with the part later to be the collecting groove 11, during the whole roll press process.

The pressure roller 7 can be moved relative to the pot 3 both axially (double arrow 70) and also in the radial direction (double row 71), and is rotatably mounted on a shaft 72.

The roll press apparatus 5 also has, at the level of the later open edge 12 of the finished open-end spinning rotor 1, a cutting device 8 which can be moved in the direction of the double arrow 80 radially of the pot 3 or of the finally shaped spinning rotor 1.

For roll pressing, the spinning rotor 1 is first fastened to the support 50 by means of the washer 54 and the screw 53, independently of the pressure roller 7 and the shaping chuck 6, and clamped in this manner. The shaping chuck 6 is now caused to travel into the interior of the pot 3. It thus assumes a position such that the whole length region of what is to be the slip wall 10 of the spinning rotor 1 to be formed is supported. This means that the shaping chuck first has a certain radial distance to the internal wall of the pot 3, so that this wall can be pressed inwards against the shaping chuck 6. Here the shaping chuck never comes into contact at all with the region of the collecting groove 11 of the later open-end spinning rotor 1.

To form the collecting groove 11, the pressure roller 7 is pressed in the immediate neighborhood of the collecting groove 11 to be formed—on the side of the pot 3 remote from the bottom 31—against the outer wall of the pot 3. The support 50 is driven in the direction of the arrow 55, while the pressure roller 7 and the shaping chuck 6 are driven, actively or passively (by the pot 3) in the direction of the arrows 73 and 61. By the action of pressure, which is one-sided with respect to the later collecting groove 11, on the wall of the pot 3, this wall is pressed radially inward only on this side of the collecting groove 11. The other side of the collecting groove 11 is formed by the substantially radial surface of the bottom 31. This bottom 31 is supported additionally by the support formed by the receiver part 51, and is hence able to resist an axial or a radial deformation.

The collecting groove 11 of the open-end spinning rotor 1 thus arises by folding or pressing without a support [literally, "against air"]. In this plastic shaping, which causes an upsetting of the material, the collecting groove 11 is thus not contacted by the shaping chuck 6. When the forming of the collecting groove 11 is completed, the end 32 of the pot wall facing the collecting groove 11 reaches the shaping chuck 6. By further roll pressing with the pressure roller 7 against the shaping chuck 6 in the region of the pot 3 between this folded region and the open end 12, the slip wall 10 of the later spinning rotor 1 is produced.

When the spinning rotor 1 has reached its final form, the cutting device 8 is moved up towards the spinning rotor 1, and the excess open edge 13 is parted from the spinning rotor 1. The spinning rotor is thereby completed. This spinning rotor 1 is already fully ready for use for many purposes and needs no further processing, apart from a possible deburring of the open edge. The spinning rotor 1 thus has in the region of the collecting groove 11 a surface which remains uncontacted by the shaping rollers (pressure roller 7 and shaping chuck 6). This leads to good spinning results and also makes possible very narrow collecting groove cross sections.

In the process mentioned above, the collecting groove 11 is first produced by pressing. In order to specially compress the material in the region of this collecting groove 11 and thus to endow it with a special wear resistance, it is advantageous if the pressure roller 7—which extends in the described example of an embodiment only over a limited length region of the pot 3 and thus can exert a pressure only over this limited length region onto the pot 3—exerts a pressure on the wall of the pot 3, during the pressure roller's direction of motion towards the folded region, i.e., the later collecting groove 11. The stroke motion of the pressure roller 7 away from the region of the collecting groove 11 hereby takes place without exertion of pressure on the wall of the pot 3. There is thereby formed in the region of the collecting groove 11 an accumulation of material and a compression of material, which lead to a larger wall thickness, due to which the life of the spinning rotor 1 is increased. The shape of the collecting groove 11 can therefore be influenced by corresponding shaping of the receiver part 51 and by a matching pressing process.

FIG. 3 shows an example of an embodiment of a collecting groove 11 formed in this manner. The adjoining bottom 31 of the open-end spinning rotor 1 has the wall thickness a, which it has received during deep drawing in the tool 4, while the slip wall 10, due to the roll pressing, has a wall thickness b which is reduced relative to this to some degree. However, this has no disadvantageous effects on the service life of the spinning rotor 1, since during the roller pressing the material in this region (the slip wall 10) was densified and hence possesses an increased wear resistance. The material has been compressed and accumulated in the region of the collecting groove 11. The spinning rotor 1 therefore possesses here a wall thickness c which is greater than the wall thickness b of the slip wall 10 adjoining this region and also greater than the wall thickness a in the region of the bottom 31. The increase in wall thickness c depends on the intensity of the roll pressing process, as discussed later.

In principle, the described process can be used for many shapes of collecting groove; the drawing or pressing tools and shaping rollers and their motion have to be correspondingly designed. The described process is particularly good for collecting grooves which are set off from the slip wall 10 by a change in the conicity of the rotor inner wall.

FIG. 3 shows the region of a particularly preferred form of the collecting groove 11. This has a cross section such that tangents 93 and 94 or 95 and 96 or 97 and 98 to the bounding walls of the collecting groove 11, in the plane through the rotor axis, include with increasing distance from the floor 15 of the collecting groove 11 a constantly increasing angle $\alpha_1$, $\alpha_2$ or $\alpha_3$ between them. Here it is sufficient for only one bounding wall to be angled away or convex, while the other bounding wall can also be constructed, if need be, rectilinear as seen in cross section. Such a collecting groove 11 makes possible, on the one hand, a good compressiion of the fibers in the fiber ring, but also facilitates, on the other hand, due to the progressively widening cross section, a low-friction yarn takeoff from the collecting groove 11. There is thus obtained a configuratiion which favors piecing-up, while giving good yarn results.

As mentioned at the beginning, various materials are suitable as starting material for the production of the spinning rotor 1; apart from sheet metals as mentioned, of aluminum, steel, spring steel, or non-ferrous metals, plates of various plastics or other materials can also be found to be suitable. For this, their properties as regards chipless deformation and in relation to the fiber material, and also their wear-resistance and deformation resistance, are decisive. Deep drawing, drawing, extrusion, and pressing processes are suitable for plastic deformation.

It has been found that this surface which has remained uncontacted by the shaping rollers 6, 7 is of decisive importance for obtaining good spinning results. Even collecting grooves whose surfaces have been polished according to the prior art and which have irregularities only of the order of about 1 $\mu$m have not led to such good results, as regards wear-resistance and the uniformity of the yarn, number of areas of increased cross-section in the yarn (slabs) or areas of reduced cross-section in the yarn, number of yarn breaks, ease of piecing-up, and self-cleaning, as collecting grooves 11 which have been produced in the manner described above. Trials have shown that the surface of the collecting grooves produced in accordance with the described process have a relatively high roughness, of the order of 15 $\mu$m. The surface of the finished, folded collecting groove 11 is similar in a certain way to that of an orange, with islets which are arranged closely adjacent and which are variously shaped and elevated to various degrees. It is assumed that these islets—which have received a relatively smooth surface during the production of the flat material (e.g., metal sheet 2) used as starting material, by rolling or by a pressure exerted in some other way—reduce the friction between the spun yarn and the collecting groove because of the interspaces of the islets, and thus result in the improvement of the yarn values. In many cases, therefore, a plating of the rotor surface to improve yarn quality can be omitted.

Since the production of open-end spinning rotors according to the described process is extraordinarily inexpensive, they can be produced without further processing as so-called disposable parts. It is however of course possible to provide a surface plating or amelioration, as this is also often desired even for open-end spinning rotors which have been produced by chipless deformation.

When a surface plating is desired, for example because the carrier material indeed has good strength and deformation properties but has unfavorable properties in relation to spinning (poor yarn values), the starting or flat material provided as substrate (e.g., sheet metal 2) can be provided with a corresponding plating. In order to achieve both the advantages of the plating and also the advantages of the surface as described, this plating is applied—where possible—to the material before this flat material undergoes a chipless deformation. For example, a cold-rolled fine steel sheet can be given a zinc plating by anodic galvanizing. After the plating, this sheet metal, known as "Zincor" sheet metal, is then formed into the spinning rotor 1 in the manner described above, by stamping, plastic deformation, and roll pressing.

Also in an open-end spinning rotor 1 produced from a plated flat material, the surface in the region of the later collecting groove undergoes no mechanical processing at all which could affect the surface structure. The spinning rotor 1 therefore possesses, in the region of its collecting groove 11, a substantially unchanged surface as compared to the unshaped surface.

According to the flat material used for processing, it can be pressed more or less easily into the shape of the spinning rotor 1. It is therefore appropriate for the number of pressure displacements—which corresponds to the number of working strokes of the pressing roll 7—and/or the pressure hereby exerted on the material of the pot 3, is varied to match the material selected for the open-end spinning rotor 1. Because of this, the shape of the collecting groove 11 is also affected. Besides this, certain materials—e.g., plastics—require the supply of heat in order to make deep drawing and roller pressing possible at all.

In order to increase the wear-resistance of the open-end spinning rotor over that of the starting flat material, (e.g., metal sheet 2), a heat—and/or chemical and/or even electrochemical treatment of the inner surface of the finished spinning rotor 1 is possible instead of plating the starting material or in addition to this. All known processes (hardening, annealing to reduce strains in the material, nitriding, etc.) can be used for this purpose, since these processes increase wear resistance by diffusion and not by a mechanical action on the surface. It is also possible to apply to the spinning rotor 1 a chemical treatment such that the edge 12 cut off at the end of roll pressing is deburred and the internal surface of the spinning rotor 1 is polished (e.g., by the so-called "Carbochem" process, for carbon steels).

With a flat material which already possesses a higher wear-resistance per se or due to a plating or a later heat—and/or chemical or electrochemical treatment, it is not absolutely necessary to specially compress the material in the region of the collecting groove 11. In such a case it is not necessary, during roll pressing in which the pressure acting radially inwards is always only exerted on a limited length region of the pot 3, that the pressure displacement always takes place from the open edge of the pot in the direction towards the collecting groove 11 as was described above. On the contrary, the pressure displacement in the axial direction along the pot wall can take place in pendular fashion in both directions, so that the strokes of the pressure roller 7 in both stroke directions are working strokes.

It is not imperatively necessary, and depends on the flat material to be processed also, that the pressing process begins in the neighborhood of the collecting groove 11 to be formed. On the contrary, it is entirely possible for the presser roll 7 to begin its pressing work in the region of the open edge 12 and to extend its working strokes always further in the direction of the region of the later collecting groove 11, with the strokes following the inclination of the shaping chuck 6—likewise, of course, also in the case in which the roll pressing begins in the neighborhood of the later collecting groove 11. With roll pressing beginning at the open edge 12, so that the shaping chuck 6 is always located in the working region, it is necessary that it is displaced in the axial direction corresponding to the progress of work, to insure that the roll pressing always takes place in a controlled manner.

It is also possible to provide a pressing roll 7 which extends over the whole region to be pressed—i.e., from the open edge 12 as far as the neighborhood of the region to be folded. In this case, the pressing roll 7 is to be displaced only in the radial direction, while the shaping chuck 6 must be displaced in the axial direction corresponding to the progress of the work.

As a rule, lengthening and deformation of the open edge of the spinning rotor 1 cannot be completely avoided during roller pressing. Apart from this, processing by roller pressing is only possible over the whole length of the spinning rotor 1 when this length is greater than that to be processed during roller pressing. For this purpose, during the process hitherto described, the pot 3 is first brought out during deep drawing over the length extent necessary for the later spinning rotor 1. The excess open edge 13 is therefore cut off at least once on conclusion of roller pressing, in association with this, by means of the cutting device 8 of the roll pressing apparatus 5. However, if it should be convenient, cutting off of an excess edge 13 can also additionally be carried out already in the spinning rotor still bein shaped or even already before the beginning of roller pressing—thus between plastic deformation, e.g., deep drawing, and the roller pressing.

It has been assumed in the preceding description that the pot is not moved axially during the roller pressing process, while the shaping rollers (shaping chuck 6 and pressing roller 7) are moved in the axial direction. In the embodiment described, the position of the cutting devices 8 and 81 is also adjustable in the axial direction. Of course it is also possible, in contrast to this, to hold the shaping rollers 6 and 7 and also the cutting devices 8 and 81 stationary in the axial direction and to produce the required relative motion with respect to the pot 3 by an axial movement of the support 50.

Open-end spinning rotors 1 are usually fastened by means of screws or other axially arranged fastening means to a shaft (DE-OS No. 2,504,401) or base body (DE-PS No. 2,939,325, FIG. 2 corresponding to U.S. Pat. No. 4,339,911). The manner in which the hole 30 required for this is stamped out of the bottom 31 of the pot 3 during the plastic deformation has been explained above. Of course, it is also possible to carry out the stamping of the sheet metal disk 21, from which the pots 3 are made by plastic deformation, separately from the deformation; likewise, also, stamping out of the sheet metal disks 22 for form the holes 30 can be carried out independently of the previously named first stamping process and also of the deformation. However, carrying out these working steps in a single working step is particularly economical of time and hence particularly advantageous. Here the hole 30 acts not only for the later fastening of the spinning rotor 1 to its shaft or base body, but also, in a particularly simple manner, for the chucking, and hence the mounting and securing, of the pot 3 in the roller pressing apparatus 5 for the duration of roller pressing.

In order not to have to balance the spinning rotor 1 by removal[of material], which would lead to undesired weakening of cross section with the thin cross sections of chiplessly shaped spinning rotors 1, it is provided that the spinning rotor 1, after being shaped, is balanced by displacement of its axis of rotation into its axis of inertia. For this purpose, the hole 30 is first stamped out of the bottom 31 of the pot 3 smaller than is later required for the mounting of the spinning rotor 1 on its shaft etc. The hole 30 is then first enlarged to the desired diameter during balancing. Such a process is known in principle (see reprint from "Werkstatt and Betrieb" [Workshop and Operation], Carl Hauser Zeitschriftenverlag GmbH, Munich 27, 92d year 1959, Vol. 3, page 5, FIG. 9-$B_1$) and is therefore not explained in detail here.

It is not in every case necessary for the finished open-end spinning rotor 1 to have a hole 30 in its bottom 31 (DE-PS No. 2,939,325, FIG. 1, or DE-OS No. 2,939,326, FIGS. 1 and 3 corresponding to U.S. Pat. No. 4,319,449). In this case, there can be provided for securing the spinnning rotor 1 in the roller pressing apparatus 5, independently of the shaping chuck 6 and the pressing roll 7, an axially displaceable central [spindle-] sleeve (not shown), which axially enters the internal space of the pot 3 and is brought into abutment with its bottom 31, and thus presses the pot 3 fast against the receiver part 51. The shaping chuck 6 can also be mounted on this spindle.

It is important that the open-end spinning rotor 1 offers a sufficient deformation resistance at high rates of rotation also. The spinning rotor 1 is reinforced in the region of its maximum diameter by the folded region around the collecting groove 11. In order to make the open edge 12 also immune to high speeds of rotation, this possesses, according to FIG. 2 (right-hand side) a reinforcement, constructed as a beading 14, on the outer periphery of the open edge 12 of the spinning rotor 1. As shown in FIG. 2, the formation of this beading on the open edge 12 takes place by exertion of pressure on the open edge in varying directions (see arrows 9, 90, 91 and 92). If desired, this beading can be preceded by a parting process by means of a radially movable cutting device 81 (see double arrow 82), in order to achieve a defined beading. Other reinforcements of the open edge 12 of the spinning rotor, e.g. by turning over and rolling inwards instead of outwards, or by application of a ring, are certainly possible.

The production of a spinning rotor 1 by roller pressing was described above as an example of an embodiment, but other processes of plastic deformation can be used. It is important for the achievment of the advantages set out that in the plastic deformation the starting material is at first strectched, as a result of which a surface arises which is similar to that of an orange. This surface should no longer be disturbed by later processing. In this further processing the pot undergoes a plastic deformation which causes upsetting of the material; at least the collecting groove 11 here comes into no proximate contact with any shaping tool.

Multistage pressing of the pot 3 without support is described below with reference to FIG. 4; the whole internal surface of the part later to be open-end spinning rotor 1 has a surface which is uncontacted by shaping tools.

The dies 57 with the inserted pot 3 are located on a baseplate 56. The die 57 has a centering bolt 58 and a centering shoulder 59 for centering the pot during pressing. The centering bolt extends through a hole 30 which is arranged centrally in the bottom 31 of the pot 3 and as far as the internal space of the pot 3, while the centering shoulder 59 engages around the outer periphery of the pot 3.

Above the dies 57 is located a carrier plate 74 which carries several shaping rings 75, 76 and 77. Each shaping ring 75, 76 and 77 is associted with another working position I, II and III, into which the dies 57 can be successively brought in a suitable way. The shaping rings 75, 76 and 77 are here constructed differently in that they can plastically shape the pot 3 in an open-end spinning rotor 1 by pressing in three stages or steps.

The pot 3, produced by a plastic shaping (which causes stretching), is first inserted into the die 57 which is in the working position I; the pot 3 is precisely fixed in its radial position by means of the centering bolt 58 and the centering shoulder 59. In a first stroke movement, which is limited by the stop columns 78 and 79 fastened to the carrier plate 74, the upper end 32 of the pot 3 is pressed somewhat radially inwards. The carrier 74 is then raised again, so that the shaping ring 75 can have associated with it a stripper (not shown). In a suitable manner, e.g. by means of an advancing apparatus which is not shown, the die 57 with the pot 3 is now brought into the working position II, while a new die 57 is brought with a new pot 3 into the working position I. Both pots now are subject to a second stroke motion. In working position I, the pot 3 located there is newly prepared for work in working position II, while the previously treated pot is further plastically deformed in working position II by the shaping ring 76. After the pretreated pot has again been released by the shaping rings 75 and 76, the dies 57 with the pots are again brought by an advancing movement into the next working position II or III, while a new die 57 is brought with a new pot 3 into the working position I. During the stroke movement which now follows, the pots 3 located in working positions I and II are deformed plastically in the manner already described, while in working position III the pretreated pot receives the final rotor shape. The finished spinning rotor 1 is taken out of the die located in working position III and can now be fed to further processing for parting the excess edge, reinforcing the edge, balancing, etc., as has been described in connection with the spinning rotor 1 produced by roller pressing.

As shown in FIG. 4, pressing takes place unsupported ["against air"]. In the described example of an embodiment, a three-sequence tool is provided for this, but the number of working strokes plays no decisive part in the plastic deformation of the pot 3 for forming the spinning rotor 1. During this whole plastic shaping which effects upsetting of the material, the internal surface of the pot 3 is not exposed to any tool, so that the surface produced in forming the pot 3 by a plastic shaping causing stretching is not disturbed during this second plastic shaping which however causes upsetting.

The shape of the collecting groove 11 is here determined by the shape of the die 57, in particular of its centering shoulder 59, and of the shaping rings, in particular of the last shaping ring 77, and also by the axial limitation of the press movement predetermined by means of the stop columns 78 and 79.

The preceding description shows that the object of the invention can be modified in many ways. Further modifications are possible by mutual interchange of features or by their substitution by equivalents or combinations thereof, and fall within the scope of the present invention.

We claim:

1. A chiplessly formed, open-end spinning rotor comprising a pot-like body having:

(a) a generally conical slip wall; and (b) a circumferential collecting groove, the inwardly-facing surface of which has smooth, uniformly distributed islets formed without contact of a working tool thereto, which surface contacts fibers for spinning same into yarn.

2. The open-end spinning rotor of claim 1, wherein said slip walls and collecting groove are integrally formed from a single layer of material so that the material forming said surface of the groove and the inwardly-facing surface of the wall similarly have smooth, uniformly distributed islets.

3. A chiplessly formed, open-end spinning rotor having a peripheral wall, comprising:

a collecting groove, the surface of said collecting groove having a plurality of smooth, uniformly distributed islets formed without contact of a working tool thereto, and which are arranged substantially adjacent to each other over said surface, and which vary in shape and elevation so that said surface is generally unpolished in character; and a slip wall for leading fibers into said collecting groove; and wherein the wall of said rotor is generally thicker in the region of said collecting groove than in the region of said slip wall.

4. A chiplessly formed, open-end spinning rotor having a peripheral wall comprising:

a collecting groove, the surface of said collecting groove having a plurality of islets which are arranged substantially adjacent to each other over said surface, and which vary in shape and elevation so that said surface is generally unpolished in character; and a slip wall for leading fibers into said collecting groove; and wherein the wall of said rotor is generally thicker in the region of said collecting groove than in the region of said slip wall; and wherein the edge of the open end of the rotor includes reinforcement means thereabout for reinforcing such edge.

5. The spinning rotor of claim 4, wherein said reinforcement means comprises a circumferential bead provided about the external periphery of the open end of the rotor.

6. A chiplessly formed, open-end spinning rotor comprising:

(a) a slip wall;

(b) a collecting groove, the inwardly-facing yarn-contacting surface of which has smooth, uniformly distributed islets formed without contact of a working tool thereto; and (c) reinforcement means associated with the edge of the open end of the rotor.

7. A chiplessly formed, open-end spinning rotor comprising:

(a) a slip wall;

(b) a collecting groove, the inwardly-facing surface of which unpolished; and (c) reinforcement means associated with the edge of the open end of the rotor; and wherein said reinforcement means comprises a bead provided about the external periphery of the open edge.

8. A chiplessly formed, open-end spinning rotor for use with an open-end spinning machine, said rotor having a reinforced, narrow circumferential collecting groove adapted for the collection of fibers therein which are twisted together to form yarn as said rotor is rotated at high speeds, said rotor comprising:

a predetermined shaped pot having a slightly saucer shaped bottom and frusto-conical sides extending therefrom and terminating in an open, circumferential end thereof, wherein said collecting groove resides circumferentially at the juncture between said bottom and said sides, said collecting groove having an inwardly-facing surface for contacting fibers introduced to said rotor of smooth, uniformly distributed islets formed without contact of a working tool thereto.

9. A rotor as in claim 8, further wherein the inwardly-facing surfaces of said frusto-conical sides also have smooth, uniformly distributed islets formed without contact of a working tool thereto.

10. A rotor as in claim 8, wherein said reinforcement of said collecting groove comprises a densified character thereof.

11. A rotor as in claim 8, wherein said reinforcement of said collecting groove comprises a relatively thickened wall thickness thereof compared to the wall thickness of said frusto-conical sides or to said pot bottom.

12. A rotor as in claim 8, further comprising a plating layer of wear-resistant material residing on the inwardly-facing side of said pot.

13. A rotor as in claim 8, wherein said pot comprises one of plastic materials or metal materials such as aluminum, steel, spring steel, stainless steel or non-ferrous metals.

14. A rotor as in claim 8, wherein said surface islets comprise islets of approximately 15 micrometers without machining-induced scratches therein.

15. A rotor as in claim 9, wherein said surface islets comprise islets of approximately 15 micrometers without machining-induced scratches therein.

* * * * *